US009920482B2

(12) United States Patent
Benz et al.

(10) Patent No.: US 9,920,482 B2
(45) Date of Patent: Mar. 20, 2018

(54) METHOD OF INCREASING PAPER STRENGTH

(71) Applicant: ECOLAB USA INC., St. Paul, MN (US)

(72) Inventors: Bradley Benz, Parker, CO (US); Paul F. Richardson, Pittsburgh, PA (US); James L. Thomas, Heber Springs, AK (US); Mei Liu, Plainfield, IL (US); Robert M. Lowe, Chicago, IL (US)

(73) Assignee: ECOLAB USA INC., St. Paul, MN (US)

( * ) Notice: Subject to any disclaimer, the term of this patent is extended or adjusted under 35 U.S.C. 154(b) by 69 days.

(21) Appl. No.: 14/507,191

(22) Filed: Oct. 6, 2014

(65) Prior Publication Data

US 2016/0097161 A1 Apr. 7, 2016

(51) Int. Cl.

| | |
|---|---|
| ***D21H 17/38*** | (2006.01) |
| ***D21H 23/24*** | (2006.01) |
| ***D21H 17/37*** | (2006.01) |
| ***D21H 17/18*** | (2006.01) |

(52) U.S. Cl.

CPC ..... *D21H 17/38* (2013.01); *D21H 17/18* (2013.01); *D21H 17/375* (2013.01); *D21H 23/24* (2013.01)

(58) Field of Classification Search

USPC ..... 162/1–168.3, 181.1–181.8, 183, 185

See application file for complete search history.

(56) References Cited

U.S. PATENT DOCUMENTS

| | | | | |
|---|---|---|---|---|
| 2,601,597 | A | | 6/1952 | Daniel, Jr. et al. |
| 2,982,749 | A | | 5/1961 | Friedrich et al. |
| 3,102,064 | A | | 8/1963 | Wurzburg et al. |
| 3,233,962 | A | | 2/1966 | Nelson |
| 3,234,076 | A | | 2/1966 | Goldsmith |
| 3,284,393 | A | | 11/1966 | Vanderhoff et al. |
| 3,409,500 | A | | 11/1968 | Strazdins et al. |
| 3,555,932 | A | | 1/1971 | Schwerdhofer |
| 3,556,932 | A | * | 1/1971 | Coscia et al. ..... C08B 31/125 162/166 |
| 3,734,873 | A | | 5/1973 | Anderson et al. |
| 3,772,076 | A | * | 11/1973 | Keim ..... C08F 8/00 162/164.3 |
| 3,821,069 | A | | 6/1974 | Wurzburg |
| RE28,474 | E | | 7/1974 | Anderson et al. |
| RE28,576 | E | | 10/1975 | Anderson et al. |
| 3,968,005 | A | | 7/1976 | Wurzburg |
| 4,040,900 | A | | 8/1977 | Mazzarella et al. |
| 4,493,659 | A | | 1/1985 | Iwashita et al. |
| 4,533,434 | A | | 8/1985 | Yoshioka et al. |
| 4,603,176 | A | | 7/1986 | Bjorkquist et al. |
| 4,605,702 | A | | 8/1986 | Guerro et al. |
| 4,657,946 | A | | 4/1987 | Rende et al. |
| 4,915,786 | A | | 4/1990 | Sweeney |
| 4,919,821 | A | | 4/1990 | Fong et al. |
| 4,929,655 | A | | 5/1990 | Takeda et al. |
| 4,956,399 | A | | 9/1990 | Kozakiewicz et al. |
| 5,006,590 | A | | 4/1991 | Takeda et al. |
| 5,147,908 | A | | 9/1992 | Floyd et al. |
| 5,281,307 | A | | 1/1994 | Smigo et al. |
| 5,324,792 | A | | 6/1994 | Ford |
| 5,438,087 | A | | 8/1995 | Ikeda et al. |
| 5,474,856 | A | | 12/1995 | Tamagawa et al. |
| 5,501,774 | A | * | 3/1996 | Burke ..... D21H 17/44 162/164.1 |
| 5,571,380 | A | | 11/1996 | Fallon et al. |
| 5,597,858 | A | | 1/1997 | Ramesh et al. |
| 5,597,859 | A | | 1/1997 | Hurlock et al. |
| 5,605,970 | A | | 2/1997 | Selvarajan |
| 5,654,198 | A | | 8/1997 | Carrier et al. |
| 5,674,362 | A | | 10/1997 | Underwood et al. |
| 5,785,813 | A | | 7/1998 | Smith et al. |
| 5,837,776 | A | | 11/1998 | Selvarajan et al. |
| 5,865,951 | A | | 2/1999 | Kawakami et al. |
| 5,938,937 | A | | 8/1999 | Sparapany et al. |
| 5,961,782 | A | | 10/1999 | Lu et al. |
| 5,985,992 | A | | 11/1999 | Chen |
| 6,013,705 | A | | 1/2000 | Chen et al. |
| 6,013,708 | A | | 1/2000 | Mallon et al. |
| 6,077,394 | A | | 6/2000 | Spence et al. |
| 6,083,348 | A | | 7/2000 | Auhorn et al. |
| 6,190,499 | B1 | | 2/2001 | Oriaran et al. |
| 6,238,521 | B1 | | 5/2001 | Shing et al. |

(Continued)

FOREIGN PATENT DOCUMENTS

| | | | |
|---|---|---|---|
| CA | 2176898 | C | 10/2006 |
| DE | 4426620 | A1 | 2/1995 |
| EP | 0151994 | A2 | 8/1985 |
| EP | 183466 | B1 | 8/1990 |
| EP | 657478 | A2 | 6/1995 |
| EP | 630909 | B1 | 10/1998 |
| EP | 1195259 | A2 | 4/2002 |
| EP | 1579071 | B1 | 7/2008 |
| JP | H06-299494 | A | 10/1994 |
| JP | 2005-001197 | A | 1/2005 |
| JP | 2008-049688 | A | 3/2008 |
| JP | 2012-107356 | A | 6/2012 |
| JP | 05247883 | B2 | 7/2013 |

(Continued)

OTHER PUBLICATIONS

PCT International Search Report and Written Opinion for corresponding application PCT/US2015/054064, dated Nov. 30, 2015 (13 pages).

(Continued)

*Primary Examiner* — Dennis Cordray

(74) *Attorney, Agent, or Firm* — Eric D. Babych; Brinks Gilson & Lione

(57) ABSTRACT

The invention provides methods and compositions for increasing the strength of a paper sheet. The method involves adding to the paper sheet an amine containing polymer. The amine containing polymer interacts with materials such as GPAM or starch to make the paper stronger in terms including tensile strength, surface strength and bulk strength.

16 Claims, No Drawings

(56) References Cited

U.S. PATENT DOCUMENTS 6,245,874 B1 6/2001 Staib et al.
6,315,866 B1 11/2001 Sanchez et al.
6,348,132 B1 2/2002 Zhang et al.
6,426,383 B1 7/2002 Fong et al.
6,472,487 B2 10/2002 Schroeder et al.
6,491,790 B1 12/2002 Proverb et al.
6,592,718 B1 7/2003 Shing et al.
6,610,209 B1 8/2003 Sommese et al.
6,616,807 B1 9/2003 Dyllick-Brenzinger et al.
6,699,359 B1 3/2004 Luu et al.
6,743,335 B2 6/2004 Proverb et al.
6,746,542 B1 6/2004 Lorencak et al.
6,787,574 B1 9/2004 Farley et al.
6,815,497 B1 11/2004 Luu et al.
6,939,443 B2 9/2005 Ryan et al.
7,034,087 B2 4/2006 Hagiopol et al.
7,119,148 B2 10/2006 Hagiopol et al.
7,125,469 B2 10/2006 Barcus et al.
7,291,695 B2 11/2007 Wei et al.
7,323,510 B2 1/2008 Fischer et al.
7,455,751 B2 11/2008 Ward et al.
7,488,403 B2 2/2009 Hagiopol et al.
7,550,060 B2 6/2009 Jacobson et al.
7,615,135 B2 11/2009 Harrington et al.
7,641,766 B2 1/2010 St John et al.
7,641,776 B2 1/2010 Nagar et al.
7,683,121 B2 3/2010 Wei et al.
7,740,743 B2 6/2010 Singh et al.
7,794,565 B2 9/2010 Shannon et al.
7,863,395 B2 1/2011 Hagiopol et al.
7,897,013 B2 3/2011 Hagiopol et al.
7,914,646 B2 3/2011 Duggirala et al.
7,938,934 B2 5/2011 Todorovic et al.
7,972,478 B2 7/2011 Hund et al.
8,025,924 B2 9/2011 Ohira et al.
8,070,914 B2 12/2011 Ryan et al.
8,088,213 B2 1/2012 Cheng et al.
8,088,250 B2 1/2012 Cheng et al.
8,288,502 B2 10/2012 Bode et al.
8,349,134 B2 1/2013 Esser et al.
8,382,947 B2 2/2013 Skaggs et al.
8,404,083 B2 3/2013 Haehnle et al.
8,414,739 B2 4/2013 Kimura et al.
8,425,724 B2 4/2013 Ryan et al.
8,444,818 B2 5/2013 Sutman et al.
8,454,798 B2 6/2013 Ban et al.
8,465,623 B2 6/2013 Zhao et al.
8,636,875 B2 1/2014 McKay
8,647,472 B2 2/2014 Cheng et al.
8,696,869 B2 4/2014 Borkar et al.
8,709,207 B2 4/2014 Grimm et al.
8,709,208 B2 4/2014 Zhao et al.
RE44,936 E 6/2014 St John et al.
8,747,617 B2 6/2014 Cheng et al.
8,753,480 B2 6/2014 Bode et al.
8,840,759 B2 9/2014 Benz et al.
8,852,400 B2 10/2014 St. John et al.
8,882,964 B2 11/2014 Zhao et al.
8,894,817 B1 11/2014 Cheng et al.
8,920,606 B2 12/2014 Wright
8,999,111 B2 4/2015 Castro et al.
9,011,643 B2 4/2015 Gu et al.
9,034,145 B2 5/2015 Castro et al.
9,051,687 B2 6/2015 Esser et al.
9,145,646 B2 9/2015 Benz et al.
9,328,462 B2 * 5/2016 Chen et al. ..... D21H 17/375 162/164.6
9,624,623 B2 4/2017 St John et al.
2003/0224945 A1 12/2003 Twu et al.
2004/0060677 A1 4/2004 Huang
2004/0084162 A1 5/2004 Shannon et al.
2006/0037727 A1 2/2006 Hagiopol et al.
2006/0142535 A1 6/2006 Cyr et al.
2006/0201645 A1 9/2006 Ito
2007/0000630 A1 1/2007 Hassler et al.
2008/0149287 A1 6/2008 Hagiopol et al.
2008/0196851 A1 8/2008 Hund et al.
2008/0277084 A1 11/2008 Denowski et al.
2008/0308242 A1 12/2008 Lu et al.
2009/0107644 A1 4/2009 Cowman et al.
2009/0145566 A1 6/2009 Esser et al.
2009/0165978 A1 7/2009 Hagiopol et al.
2009/0281212 A1 11/2009 Pawlowska et al.
2010/0193147 A1 8/2010 Ryan et al.
2010/0193148 A1 8/2010 McKay et al.
2011/0083821 A1 4/2011 Wright
2011/0112224 A1 5/2011 Borkar et al.
2011/0132559 A1 6/2011 Haehnle et al.
2011/0146925 A1 * 6/2011 Bode ..... C08L 33/26 162/164.1
2011/0155339 A1 6/2011 Brungardt et al.
2012/0035306 A1 2/2012 Ryan et al.
2012/0073773 A1 3/2012 Jehn-Rendu et al.
2012/0073774 A1 3/2012 Jehn-Rendu et al.
2012/0103546 A1 5/2012 Maniere
2012/0103547 A1 5/2012 Grimm et al.
2012/0111517 A1 5/2012 Borkar et al.
2012/0186764 A1 7/2012 McKay
2013/0081771 A1 * 4/2013 Luo ..... D21H 17/55 162/164.6
2013/0133847 A1 5/2013 Zhao et al.
2013/0139985 A1 6/2013 Wright
2013/0160959 A1 * 6/2013 Rosencrance ..... D21H 17/56 162/164.6
2013/0192782 A1 8/2013 Benz et al.
2013/0306261 A1 11/2013 Zhao et al.
2014/0053996 A1 * 2/2014 Esser ..... D21H 17/37 162/164.3
2014/0060763 A1 3/2014 Bode et al.
2014/0130994 A1 5/2014 St. John et al.
2014/0182799 A1 7/2014 Castro et al.
2014/0262091 A1 * 9/2014 Lu ..... D21H 17/07 162/164.6
2014/0284011 A1 9/2014 Krapsch et al.
2014/0336314 A1 11/2014 Benz et al.
2015/0020988 A1 1/2015 St John et al.
2015/0041088 A1 2/2015 Castro et al.
2015/0041089 A1 2/2015 Castro et al.
2015/0041092 A1 2/2015 Hietaniemi et al.
2015/0059998 A1 3/2015 Zhao et al.
2015/0176206 A1 6/2015 Chen et al.
2015/0191875 A1 7/2015 Esser et al.
2015/0197893 A1 7/2015 Cheng et al.
2015/0204019 A1 7/2015 Wright
2015/0299961 A1 10/2015 Borkar et al.
2016/0097160 A1 4/2016 Castro et al.
2016/0097161 A1 4/2016 Benz et al.

FOREIGN PATENT DOCUMENTS

WO WO 1997/05330 A1 2/1997
WO WO 1997/10387 A1 3/1997
WO WO 2000/11053 A1 3/2000
WO WO 2004-061235 A1 7/2004
WO WO 2004/072376 A1 8/2004
WO WO 2008-028865 A2 3/2008
WO WO 2012-007364 A1 1/2012
WO WO 2013/078133 A1 5/2013
WO WO 2013/192082 A1 12/2013
WO WO 2014-078102 A1 5/2014

OTHER PUBLICATIONS

Farley, C.E. "Glyoxalated Polyacrylamide Resin," Wet-Strength Resins and Their Application, Chapter 3. Atlanta, GA: TAPPI Press, 1994, pp. 45-61.

Farley, C.E. and R.B. Wasser. "Sizing with Alkenyl Succinic Anhydride," The Sizing of Paper, 2nd Ed. Atlanta, GA: TAPPI Press, 1989, pp. 51-62.

Friberg, S.E. and S. Jones. "Emulsions," Encyclopedia of Chemical Technology, 4th Ed. vol. 9. Published Online Dec. 4, 2000, pp. 393-413.

(56) References Cited

OTHER PUBLICATIONS

Hercobond Product Analysis (2002), Nalco Chemical Company, one page.
Hunkeler, et al. "Mechanism, Kinetics and Modeling of the Inverse-Microsuspension Homopolymerization of Acrylamide," Polymer. vol. 30, No. 1, 1989, pp. 127-142.
Hunkeler et al. "Mechanism, Kinetics and Modeling of Inverse-Microsuspension Polymerization: 2. Copolymerizaton of Acrylamide with Quaternary Ammonium Cationic Monomers," Polymer. vol. 32, No. 14, 1991, pp. 2626-2640.
Parez Product Analysis (1999), Nalco Chemical Company, 30 pages.
St. John, M.R., "Ondeo-Nalco Technical Exchange." Jun. 27, 2002, 5 pages.
EPO Extended European Search Report for EP App. No. 13855150.2, dated Jun. 15, 2016, 12 pages.
PCT International Search Report and Written Opinion for PCT/US2015/054069, dated Jan. 22, 2016 (13 pages).
Nie, Xun-zai, "Papermaking Process," China Light Industry Press, 1999, p. 65, 6 pages, with English Abstract.
Parez Product Analysis (1999), Nalco Chemical Company, 20 pages.
Smook, Gary A. "Non-fibrous Additives to Papermaking Stock," Handbook for Pulp and Paper Technologists, 2nd Ed. Vancouver, BC: Angus Wilde Publications Inc, 1992, pp. 220-227.
"AEGO™ Sizer F—The PMT Film Size Press: How to improve paper strength properties, surface and machine runnability," TAPPSA Journal, vol. 5 (2013), pp. 38-40.
Au, C.O. and I.Thorn, Editors, "Applications of Wet-End Paper Chemistry." 1995: Springer Science+Business Media Dordrecht, pp. 76-90.
Biricik, Yagmur, S. Sonmex, and O Ozden, "Effects of Surface Sizing with Starch on Physical Strength Properties of Paper," Asian Journal of Chemistry, vol. 23, No. 7 (2011) pp. 3151-3154.

* cited by examiner

METHOD OF INCREASING PAPER STRENGTH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to compositions, methods, and apparatuses for improving, wet strength, bulk strength, and dry strength of paper in a papermaking process. A typical papermaking process includes the steps of: 1) pulping wood or some other source of papermaking fibers; 2) producing a paper mat from the pulp, the paper mat being an aqueous slurry of cellulosic fiber which may also contain additives such as inorganic mineral fillers or pigments; 3) depositing this slurry on a moving papermaking wire or fabric; 4) forming a sheet from the solid components of the slurry by draining the water; 5) pressing and drying the sheet to further remove water, and 6) potentially rewetting the dry sheet by passing it through a size press and further drying it to form a paper product.

When conducting a papermaking process, a number of concerns need to be taken into account to assure the quality of the resulting paper product. For example when draining water from the slurry, as many fibers and chemical additives should be retained and not flow out with the water. Similarly the resulting sheet should have adequate wet strength and dry strength.

As described for example in U.S. Pat. Nos. 8,465,623, 7,125,469, 7,615,135 and 7,641,776 a number of materials function as effective dry strength agents. These agents can be added to the slurry to increase the strength properties of the resulting sheet. These agents however must both allow for the free drainage of water from the slurry and also must not interfere with or otherwise degrade the effectiveness of other additives present in the resulting paper product.

As described for example in U.S. Pat. Nos. 8,414,739 and 8,382,947, surface strength agents are materials which increase the resistance of the resulting paper product to abrasive forces. Surface strength agents are often applied as coatings over the formed paper sheet at the size press. Of particular importance is that such agents be compatible with other items present in coatings such as sizing agents and optical brightening agents. In addition desirable surface strength agents must not unduly impair the flexibility of the resulting paper product.

As it is difficult to increase dry strength, surface strength, and/or drainage retention while simultaneously not inhibiting other attributes of the paper or additives therein, there is an ongoing need for improved methods of improving dry strength, surface strength, and/or drainage retention.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

To satisfy the long-felt but unsolved needs identified above, at least one embodiment of the invention is directed towards a method of strengthening paper. The method comprises the step of contacting a paper sheet in the wet end of a papermaking process with a composition. The composition comprises a GPAM polymer and an amine containing polymer. The GPAM polymer and an amine containing polymers may be added at different points in the wet end. The GPAM polymer and an amine containing polymers may be separately added at substantially the same location within the wet end but are not pre-mixed. The GPAM polymer and an amine containing polymers may be pre-mixed before being co-fed into the wet end. The amine containing polymer may comprise a DAA/AcAM polymer. The resulting paper produced by the papermaking process may have a greater strength than what would have been produced ad no GPAM been added but a greater amount of amine containing polymer had been added. At least some of the GPAM and the amine containing polymer may be mixed together by a rapid mixing apparatus prior to their contacting the paper sheet. The amine containing polymer may be each respectively fed into the apparatus via one of two distinct process flows, the flows being a carrier water flow of the papermaking process and a carrier water line of the papermaking process. At least some of the GPAM and the amine containing polymer may contact each other after they have contacted the paper sheet. The GPAM and the amine containing polymer may crosslink to produce a higher molecular weight molecule. The amine containing polymer may be added at an active basis dosage of 0.1 to 5000 gm/ton of oven dried paper sheet. The GPAM polymer may be added at an active basis dosage of 0.1 to 5000 gm/ton of oven dried paper sheet. At least 10% of the oven dried mass of the paper sheet may be filler particles and the paper may have a strength greater than a similar paper sheet lacking the amine containing polymer with at least a 2% lower or 2% greater amount of filler particles.

Additional features and advantages are described herein, and will be apparent from, the following Detailed Description.

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category.

"Coagulant" means a water treatment chemical often used in solid-liquid separation stage to neutralize charges of suspended solids/particles so that they can agglomerate, coagulants are often categorized as inorganic coagulants, organic coagulants, and blends of inorganic and organic coagulants, inorganic coagulants often include or comprise aluminum or iron salts, such as aluminum sulfate/choride, ferric chloride/sulfate, polyaluminum chloride, and/or aluminum chloride hydrate, organic coagulants are often positively charged polymeric compounds with low molecular weight, including but not limited to polyamines, polyquaternaries, polyDADMAC, Epi-DMA, coagulants often have a higher charge density and lower molecular weight than a flocculant, often when coagulants are added to a liquid containing finely divided suspended particles, it destabilizes and aggregates the solids through the mechanism of ionic charge neutralization, additional properties and examples of coagulants are recited in *Kirk-Othmer Encyclopedia of Chemical Technology,* 5th Edition, (2005), (Published by Wiley, John & Sons, Inc.).

"DADMAC" means monomeric units of diallyldimethylammonium chloride, DADMAC can be present in a homopolymer or in a copolymer comprising other monomeric units.

"Dry End" means that portion of the papermaking process including and subsequent to a press section where a liquid medium such as water typically comprises less than 45% of the mass of the substrate, dry end includes but is not limited to the size press portion of a papermaking process, additives added in a dry end typically remain in a distinct coating layer outside of the slurry.

"Dry Strength" means the tendency of a paper substrate to resist damage due to shear force(s), it includes but is not limited to surface strength.

"Flocculant" means a composition of matter which when added to a liquid carrier phase within which certain particles are thermodynamically inclined to disperse, induces agglomerations of those particles to form as a result of weak physical forces such as surface tension and adsorption, flocculation often involves the formation of discrete globules of particles aggregated together with films of liquid carrier interposed between the aggregated globules, as used herein flocculation includes those descriptions recited in ASTME 20-85 as well as those recited in Kirk-Othmer Encyclopedia of Chemical Technology, 5th Edition, (2005), (Published by Wiley, John & Sons, Inc.), flocculants often have a low charge density and a high molecular weight (in excess of 1,000,000) which when added to a liquid containing finely divided suspended particles, destabilizes and aggregates the solids through the mechanism of interparticle bridging.

"Flocculating Agent" means a composition of matter which when added to a liquid destabilizes, and aggregates colloidal and finely divided suspended particles in the liquid, flocculants and coagulants can be flocculating agents.

"GCC" means ground calcium carbonate filler particles, which are manufactured by grinding naturally occurring calcium carbonate bearing rock.

"GPAM" means glyoxalated polyacrylamide, which is a polymer made from polymerized acrylamide monomers (which may or may not be a copolymer comprising one or more other monomers as well) and in which acrylamide polymeric units have been reacted with glyoxal groups, representative examples of GPAM are described in US Published Patent Application 2009/0165978.

"HLB" means the hydrophillic-lipophillic balance of a material which is a measure of the degree to which it is hydrophilic or lipophilic, it can be determined by the equation:

$$HLB=20*Mh/M$$

in which Mh is the molecular mass of the hydrophilic portion of the Molecule, and M is the molecular mass of the whole molecule, giving a result on a scale of 0 to 20. An HLB value of 0 corresponds to a completely lipidphilic/hydrophobic material, and a value of 20 corresponds to a completely hydrophilic/lypidphobic material. HLB values are characterized as:

HLB<10: Lipid soluble (water insoluble)

HLB>10: Water soluble (lipid insoluble)

HLB from 4 to 8 indicates an anti-foaming agent

HLB from 7 to 11 indicates a W/O (water in oil) emulsifier

HLB from 12 to 16 indicates O/W (oil in water) emulsifier

HLB from 11 to 14 indicates a wetting agent

HLB from 12 to 15 indicates a detergent

HLB of 16 to 20 indicates a solubiliser or hydrotrope.

"Paper Product" means the end product of a papermaking process it includes but is not limited to writing paper, printer paper, tissue paper, cardboard, paperboard, and packaging paper.

"Papermaking process" means any portion of a method of making paper products from pulp comprising forming an aqueous cellulosic papermaking furnish, draining the furnish to form a sheet and drying the sheet. The steps of forming the papermaking furnish, draining and drying may be carried out in any conventional manner generally known to those skilled in the art. The papermaking process may also include a pulping stage, i.e. making pulp from a lignocellulosic raw material and bleaching stage, i.e. chemical treatment of the pulp for brightness improvement, papermaking is further described in the reference *Handbook for Pulp and Paper Technologists,* 3rd Edition, by Gary A. Smook, Angus Wilde Publications Inc., (2002) and *The Nalco Water Handbook* (3rd Edition), by Daniel Flynn, McGraw Hill (2009) in general and in particular pp. 32.1-32.44.

"RSV" means reduced specific viscosity, an indication of polymer chain length and average molecular weight. The RSV is measured at a given polymer concentration and temperature and calculated as follows:

$$RSV = \frac{\left[\left(\frac{\eta}{\eta_o}\right) - 1\right]}{c}$$

Wherein $\eta$=viscosity of polymer solution; $\eta_o$=viscosity of solvent at the same temperature; and c=concentration of polymer in solution. As used herein, the units of concentration "c" are (grams/100 ml or g/deciliter). Therefore, the units of RSV are dl/g. The RSV is measured at 30 degrees C. The viscosities $\eta$ and $\eta_o$ are measured using a Cannon-Ubbelohde semimicro dilution viscometer, size 75. The viscometer is mounted in a perfectly vertical position in a constant temperature bath adjusted to 30+−0.02 degrees C. The error inherent in the calculation of RSV is about 2 dl/g. Similar RSVs measured for two linear polymers of identical or very similar composition is one indication that the polymers have similar molecular weights, provided that the polymer samples are treated identically and that the RSVs are measured under identical conditions.

"Slurry" means a mixture comprising a liquid medium such as water within which solids such as fibers (such as cellulose fibers) and optionally fillers are dispersed or suspended such that between >99% to 45% by mass of the slurry is liquid medium.

"S-Value" means the measure of the degree of microaggregation of colloidal materials, it can be obtained from measurements of viscocity of the colloidal system and is often related to the performance of the colloidal end product, its exact metes and bounds and protocols for measuring it are elucidated in *The Chemistry of Silica: Solubility, Polymerization, Colloid and Surface Properties and Biochemistry of Silica*, by Ralph K Iler, John Wiley and Sons, Inc., (1979).

"Size Press" means the part of the papermaking machine where the dry paper is rewet by applying a water-based formulation containing surface additives such as starch, sizing agents and optical brightening agents, a more detailed descriptions of size press is described in the reference

*Handbook for Pulp and Paper Technologists,* 3rd Edition, by Gary A. Smook, Angus Wilde Publications Inc., (2002).

"Stable Emulsion" means an emulsion in which droplets of a material dispersed in a carrier fluid that would otherwise merge to form two or more phase layers are repelled from each other by an energy barrier, the energy barrier may be at least 20 kT, more, or less, the repulsion may have a half-life of at least a few years. Enabling descriptions of emulsions and stable emulsions are stated in general in *Kirk-Othmer, Encyclopedia of Chemical Technology*, Fourth Edition, volume 9, and in particular on pages 397-403.

"STFI" means Short Span Compression Test, a method of measuring paper's resistance to compressive forces, it is defined in TAPPI Method T826 as well as the article "*The comparative response of Ring Crush Test and STFI Short Span Crush Test to paper mill process variable changes*" by Joseph J. Batelka, Corrugating International (October 2000).

"Substrate" means a mass containing paper fibers going through or having gone through a papermaking process, substrates include wet web, paper mat, slurry, paper sheet, and paper products.

"Surface Strength" means the tendency of a paper substrate to resist damage due to abrasive force.

"Surfactant" is a broad term which includes anionic, nonionic, cationic, and zwitterionic surfactants. Enabling descriptions of surfactants are stated in *Kirk-Othmer, Encyclopedia of Chemical Technology*, Third Edition, volume 8, pages 900-912, and in *McCutcheon's Emulsifiers and Detergents*, both of which are incorporated herein by reference.

"Water Soluble" means materials that are soluble in water to at least 3%, by weight, at 25 degrees C.

"Wet End" means that portion of the papermaking process prior to a press section where a liquid medium such as water typically comprises more than 45% of the mass of the substrate, additives added in a wet end typically penetrate and distribute within the slurry.

"Wet Strength" means the tendency of a paper substrate to resist damage due to shear force(s) when rewet.

"Wet Web Strength" means the tendency of a paper substrate to resist shear force(s) while the substrate is still wet.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims. All illustrated chemical structures also include all possible stereoisomer alternatives.

At least one embodiment of the invention is directed towards increasing the strength of a paper product through the use of an amine containing polymer in one or more locations within the papermaking process. Contemplated embodiments include but are not limited to adding the amine containing polymer in the wet end of the papermaking process and/or as a surface chemical applied in a size press location of a papermaking process.

As described in Published US Patent Application 2014/0130994, representative amine-containing polymers may have a molecular weight greater than 10,000 Daltons, but preferably below 2,000,000 Daltons, where at least 1 mole percent and up to 99 mole percent of the mer content of the polymer is a polymerizable primary and/or secondary amine-containing monomer. In certain embodiments, the amine-containing polymers have molecular weights from 200,000 to 1,500,000 Daltons. In at least one embodiment, at least ten mole percent and up to 60 mole percent of the mer units are amine containing vinyl- or allyl-monomers. In certain embodiments, the amine-containing monomer in the polymer is diallylamine.

In at least one embodiment, the amine-containing polymer include a polymer with randomly distributed repeating monomer units derived from at least one of the following structures: Formulae I, II and/or their salt forms thereof, and/or Formula III and/or its hydrolyzed form after polymerization, denoted as Formula IIIA, where x=z=0, if the formamide is 100% hydrolyzed:

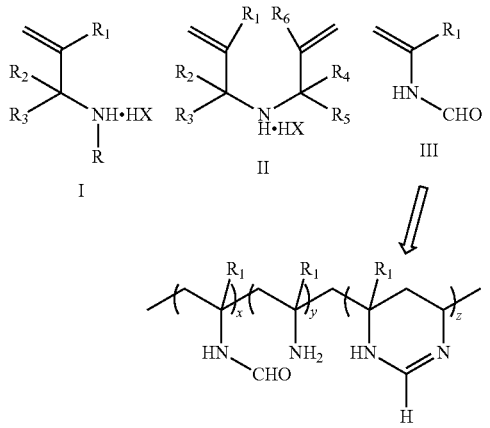

wherein R can be hydrogen or alkyl; $R_1$, $R_2$, $R_3$, $R_4$, $R_5$, $R_6$ are, independently selected from hydrogen, alkyl, or alkoxylalkyl. Formulae I, II, III, and IIIA independently may each be 0 mole percent. However, in certain embodiments where at least one of Formula I, II, III, and/or IIIA is utilized, the sum of Formulae I, II, III, and/or IIIA is from one mole percent up to 99 mole percent, based upon the amine-containing polymer or copolymer.

In at least one embodiment the amine-containing polymer is a copolymer. Various co-monomer(s) may be useful, including, but not limited to, one or more vinyl addition monomers including non-ionic, cationic, anionic, and zwitterionic, with non-ionic and cationic being the preferred co-monomers. The co-monomer(s) is preferably water-soluble or at least results in a water-soluble copolymer.

Representative non-ionic co-monomers include acrylamide, methacrylamide, N,N-dimethylacrylamide, N,N-diethylacrylamide, N-isopropylacrylamide, N-vinylformamide, N-vinylmethylacetamide, N-vinyl pyrrolidone, hydroxyethyl methacrylate, hydroxyethyl acrylate, hydroxypropyl acrylate, hydroxypropyl methacrylate, N-t-butylacrylamide, N-methylolacrylamide, vinyl acetate, vinyl alcohol, similar monomers, and combinations thereof. In certain embodiments, the co-monomer is acrylamide.

Representative anionic co-monomers include acrylic acid and its salts, including, but not limited to sodium acrylate and ammonium acrylate; methacrylic acid and its salts, including, but not limited to sodium methacrylate and ammonium methacrylate; 2-acrylamido-2-methylpropanesulfonic acid ("AMPS"); the sodium salt of AMPS; sodium vinyl sulfonate; styrene sulfonate; maleic acid and its salts, including, but not limited to the sodium salt, the ammonium salt, sulfonate, itaconate, sulfopropyl acrylate or methacrylate or other water-soluble forms of these or other polymerizable carboxylic or sulfonic acids; sulfomethylated acrylamide; allyl sulfonate; sodium vinyl sulfonate; itaconic acid; acrylamidomethylbutanoic acid; fumaric acid; vinylphosphonic acid; vinylsulfonic acid; allylphosphonic acid; sulfomethylated acrylamide; phosphonomethylated acrylamide; itaconic anhydride; similar monomers, and combinations thereof.

Representative cationic co-monomers or mer units of the primary or secondary amine include dialkylaminoalkyl acrylates and methacrylates and their quaternary or acid salts, including, but not limited to, dimethylaminoethyl acrylate methyl chloride quaternary salt ("DMAEA.MCQ"), dimethylaminoethyl acrylate methyl sulfate quaternary salt, dimethyaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dialkylaminoalkylacrylamides or methacrylamides and their quaternary or acid salts such as acrylamidopropyltrimethylammonium chloride, dimethylaminopropyl acrylamide methyl sulfate quaternary salt, dimethylaminopropyl acrylamide sulfuric acid salt, dimethylaminopropyl acrylamide hydrochloric acid salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldiethylammonium chloride and diallyldimethyl ammonium chloride ("DADMAC"), similar monomers, and combinations thereof. When present, alkyl groups are generally $C_1$ to $C_4$ alkyl.

Representative zwitterionic co-monomers include N,N-dimethyl-N-acryloyloxyethyl-N-(3-sulfopropyl)-ammonium betaine; N,N-dimethyl-N-acrylamidopropyl-N-(2-carboxymethyl)-ammonium betaine; N,N-dimethyl-N-acrylamidopropyl-N-(3-sulfopropyl)-ammonium betaine; N,N-dimethyl-N-acrylamidopropyl-N-(2-carboxymethyl)-ammonium betaine; 2-(methylthio)ethyl methacryloyl-S-(sulfopropyl)-sulfonium betaine; 2-[(2-acryloylethyl)dimethylammonio]ethyl 2-methyl phosphate; 2-(acryloyloxyethyl)-2'-(trimethylammonium)ethyl phosphate; [(2-acryloylethyl)dimethylammonio]methyl phosphonic acid; 2-methacryloyloxyethyl phosphorylcholine ("MPC"); 2-[(3-acrylamidopropyl)dimethylammonio]ethyl 2'-isopropyl phosphate ("AAPI"); 1-vinyl-3-(3-sulfopropyl) imidazolium hydroxide; (2-acryloxyethyl) carboxymethyl methylsulfonium chloride; 1-(3-sulfopropyl)-2-vinylpyridinium betaine; N-(4-sulfobutyl)-N-methyl-N, N-diallylamine ammonium betaine ("MDABS"); N,N-diallyl-N-methyl-N-(2-sulfoethyl) ammonium betaine; similar monomers, and combinations thereof.

Generally, the amine-containing polymers used in this disclosure may take the form of water-in-oil emulsions, dry powders, dispersions, or aqueous solutions. In certain embodiments, the amine-containing polymers may be prepared via free radical polymerization techniques in water using free radical initiation.

In at least one embodiment the amine-containing polymer is a diallylamine-acrylamide ("DAA/AcAm") copolymer. The mole percentage of DAA in the amine-containing polymer may be an important variable when treating paper according to this disclosure. In certain embodiments, the amine-containing polymer is a diallylamine homopolymer. In other embodiments, the amine-containing polymer is a DAA/AcAm copolymer. In yet other embodiments, the amine-containing polymer is a mixture of DAA homopolymer and DAA/AcAm copolymer. It may also contain other polymer subunits.

In those embodiments, where a DAA/AcAm copolymer embodiment is employed, the mole percentage of DAA in the DAA/AcAm copolymer can be within a range of 1 to 99 percent. The DAA/AcAm copolymer may be primarily made up of DAA, i.e., may comprise more DAA monomer units than AcAm monomer units. In those embodiments, where cost is a deciding factor in terms of composition of the oil-in-water emulsion, a more preferable mole percentage of DAA in the amine-containing polymer may be 10 to 60, and including 10 to 40.

At least one embodiment of the invention is directed towards in part or in full, one, some, or all of the methods, compositions, and or apparatuses of one, some or all of: U.S. patent application Ser. Nos. 13/677,546, 12/938,017, and/or U.S. Pat. Nos. 8,709,207 and 8,852,400.

The amine-containing polymers may be added to the wet end (such as to the stock, i.e., the pulp slurry), independently or alongside a GPAM polymer. Thus, for example, it may be added to the pulp while the latter is in the headbox, beater, hydropulper, and/or stock chest. Representative examples of GPAM polymers, methods of producing them, and/or conditions and material they may be used with include one or more of those described in U.S. Pat. Nos. 7,897,013, 7,875,676, 7,897,013, 6,824,659, and 8,636,875 and Published US Patent Application 2013/0192782. In at least one embodiment the GPAM polymer is a polymer comprised of one or more repeating polymeric subunits according to structure IV:

IV

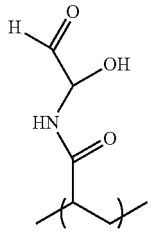

In at least one embodiment the GPAM polymer is a reaction product of a polyacrylamide bearing polymer that has undergone a glyoxalation reaction. Under suitable conditions (including but not limited to pH in the range of 7.2 to 10.0) glyoxal (CHOCHO) reacts with pendant amide groups on the polyacrylamide backbone to produce a modified polyacrylamide. The modified polyacrylamide may need to be further reacted to form an aldehyde moiety. This may be accomplished by subsequent reaction of the modified polymer with another amide group.

The GPAM polymer may be derived from a DADMAC-acrylamide backbone having any suitable mole % of DADMAC monomer. In certain embodiments, the GPAM polymer is derived from a DADMAC-acrylamide backbone having from 1 mole % to 50 mole % DADMAC monomer content, 2 mole % to 30 mole % DADMAC monomer content, 3 mole % to 25 mole % DADMAC monomer content, 4 mole % to 20 mole % DADMAC monomer content, 5 mole % to 15 mole % DADMAC monomer content, 6 mole % to 14 mole % DADMAC monomer content, 7 mole % to 13 mole % DADMAC monomer content, or 8 mole % to 12 mole % DADMAC monomer content. In certain embodiments, the GPAM polymer is derived from a DADMAC-acrylamide backbone having 1 mole % DADMAC monomer content, 2 mole % DADMAC monomer content, 3 mole % DADMAC monomer content, 4 mole % DADMAC monomer content, 5 mole % DADMAC monomer content, 6 mole % DADMAC monomer content, 7 mole % DADMAC monomer content, 8 mole % DADMAC monomer content, 9 mole % DADMAC monomer content, 10 mole % DADMAC monomer content, 11 mole % DADMAC monomer content, 12 mole % DADMAC monomer content, 13 mole % DADMAC monomer content, 14 mole % DADMAC monomer content, 15 mole % DADMAC monomer content, 16 mole % DADMAC monomer content, 17 mole % DADMAC monomer content, 18 mole % DADMAC monomer content, 19 mole % DADMAC monomer content, 20 mole % DADMAC monomer content, 21 mole % DADMAC monomer content, 22 mole % DADMAC monomer content, 23 mole % DADMAC monomer content, 24 mole % DADMAC monomer content, 25 mole % DADMAC monomer content, 26 mole % DADMAC monomer content, 27 mole % DADMAC monomer content, 28 mole % DADMAC monomer content, 29 mole % DADMAC monomer content, or 30 mole % DADMAC monomer content. In certain embodiments, the GPAM is an aldehyde-functionalized poly(DADMAC)/AcAm polymer having a 12 mole % DADMAC monomer content.

In at least one embodiment, the GPAM polymer composition further comprises one or more salts. Suitable salts for inclusion with the GPAM polymers include, but are not limited to, magnesium sulfate, magnesium sulfate monohydrate, magnesium sulfate tetrahydrate, magnesium sulfate pentahydrate, magnesium sulfate hexahydrate, and magnesium sulfate heptahydrate. In certain embodiments, the GPAM is an aldehyde-functionalized poly(DADMAC)/AcAm polymer having a 5 mole % DADMAC monomer content, said polymer composition further comprising $MgSO_4.7H_2O$. In certain embodiments, the GPAM is an aldehyde-functionalized poly(DADMAC)/AcAm polymer having a 12 mole % DADMAC monomer content, said polymer composition further comprising $MgSO_4.7H_2O$, preferably at concentrations from about 0.5 weight % to about 10 weight % based on total weight of the composition. In certain embodiments, the $MgSO_4.7H_2O$ is present in the composition at 1 wt %, 2 wt %, 3 wt %, 4 wt %, 5 wt %, 6 wt %, 7 wt %, 8 wt %, 9 wt %, 10 wt %, 11 wt %, 12 wt %, 13 wt %, 14 wt %, or 15 wt % based on total weight of the composition.

The amine-containing polymers and GPAM may be co-fed (added at the same addition point but not mixed before) or be pre-mixed (mixed together prior to addition for a given period of time) before introduction into the wet end. As will be described in more detail in the examples, the presence of both of these materials results in superior performance than either one alone provides or what would be expected from their summation of their combination. The combination both provides enhanced strength effects and enhanced retention drainage effects.

Without being limited by a particular theory or design of the invention or of the scope afforded in construing the claims, it is believed that the presence of the amine-containing polymers induces a synergy by altering the mechanism by which GPAM interacts with cellulose bearing fibers. GPAM is known to operate as a dry strength agent, a drainage retention aid, and press dewatering aid. Unfortunately GPAM's ability to enhance press dewatering has a maximum threshold after which higher dosages of GPAM do not further enhance water removal. The presence of the amine-containing polymers however increases GPAM's capacity to enhance water removal beyond its individual threshold.

The synergy may be a consequence of the functional groups in GPAM polymer crosslinking with the amine-containing polymers and thereby forming a unique 3D polymeric geometry more conducive to retention drainage effects and strength effects.

The synergy is quite unexpected as experiments have shown that amine-containing polymers alone impart dry strength benefits on the order of double those of GPAM polymers alone. As a result one would expect that a GPAM-amine-containing polymer combination would have lower strength enhancing effects than amine-containing polymers alone, yet the opposite occurs and the combination results in higher resulting dry strength.

In at least one embodiment the GPAM polymer and the amine-containing polymer are mixed prior to introduction into the papermaking process through the use of a rapid mixing apparatus. Representative examples of such rapid speed mixing apparatuses include but are not limited to those described in U.S. patent application Ser. No. 13/645,671 (Published as 2014/0096971) as well as U.S. Pat. Nos. 7,550,060, 7,785,442, 7,938,934, 8,440,052, and 7,981,251. A representative example of such a rapid mixing apparatus is a PARETO device produced by Nalco Company, Naperville, Ill.

In at least one embodiment adding the amine containing polymer (with or without a GPAM polymer) to a papermaking furnish or slurry improves wet strength. As described in U.S. Pat. No. 8,172,983, a high degree of wet strength in paper is desired to allow for the addition of more filler (such as PCC or GCC) to the paper. Increasing filler content results in superior optical properties and cost savings (filler is cheaper than fiber).

In at least one embodiment the amine containing polymer (with or without a GPAM polymer) is added to the surface of a fully or partially dried paper sheet. This could be accomplished by adding the polymer as a coating or as part of a coating or surface application of chemistry. It could be added in unit operations such as a size press, water box, or other types of coating units. The amine containing polymer may be added as a coating applied during a size press operation and may be added alongside starch, sizing agents or any other additive added during the size press.

It has long been desirable to increase the amount of filler particles (such as inorganic filler particles like PCC and/or GCC) while maintaining basis weight in an uncoated freesheet to absorb gains in optical properties alongside savings in raw material (wood) costs. This however has proven difficult as excessive filler content often results in a net loss in paper strength.

The cause and effect of this problem would suggest that addition of flocculant or coagulant polymers would worsen the strength of paper. The use of agents which enhance retention of materials during the drainage of paper sheets increases the overall percentage of filler particles within the paper sheet. As described in the scientific paper *Reducing the Dusting in Xeroxgraphic Paper through Novel Chemistry Application at the Size Press*, by David Castro et al., PaperCon Conference, Page 2219, (2013), this loss of strength manifests in a loss of surface strength which leads to large amounts of paper dusting. The use of the amine containing polymers in the dry end however overcomes this phenomenon in a manner that would not operate if it were only added in the wet end.

When in the wet end the amine containing polymers interact with free floating filler particles because of their high exposed surface areas and as a result are not available to affect as many fiber-fiber interactions as would be desired. In the dry end and especially in the size press, the reduced presence of water allows the amine containing polymers to interact more with the fiber and paper surface. These interactions result in greater strength and less dusting. In addition, because in the dry end the filler-fiber arrangement is more rigid structure than the free flowing slurry of the wet end, it has reduced movement which allows for greater fiber-fiber interactions to occur than would be the case in the wet end.

The aforementioned advantages are not limited to grades containing fillers. Any paper grade where improved strength is desirable would benefit from this method of application because this method of addition avoids contact with other interfering substances that may be present in the wet end.

In at least one embodiment the amine containing polymer is pre-mixed with one or more of GPAM, starch, alkenyl succinic anhydride, sizing agent, optical brightening agents, and or any other dry end additive and may be added at any point in the papermaking process. These polymer-additives combinations may be mixed and introduced to the paper sheet via one or more of the aforementioned rapid mixing apparatus.

In at least one embodiment the GPAM polymer and the amine-containing polymer combination (in the wet end and/or the dry end) is used to reduce the amount of filler enhancing chemistry. As described in U.S. patent application Ser. Nos. 13/399,253, 13/731,311, 14/157,437 and 14/330,839 and in U.S. Pat. Nos. 8,172,983, 8,088,213, 8,747,617, 8,088,250, 8,382,950, 8,465,632, 8,709,208, 8,778,140, and 8,647,472, a number of methods can be used to enhance the retention and resulting strength of paper which contains inorganic filler particles such as PCC and/or GCC. One, some, or all of the methods described therein can be used in conjunction with the GPAM-amine-containing polymer combination. Moreover because the GPAM-amine-containing polymer combination enhances drainage retention and strength, its use with a lessor amount of filler enhancing chemistry can be used to obtain a grade of paper having a strength and filler content that would not be possible with that dosage of the filler enhancing chemistry absent the GPAM-amine-containing polymer combination.

In at least one embodiment this invention is practiced along with the methods, compositions, and apparatuses described in the U.S. patent application Ser. No. 14/507,208.

EXAMPLES

The foregoing may be better understood by reference to the following examples, which are presented for purposes of illustration and are not intended to limit the scope of the invention. In particular the examples demonstrate representative examples of principles innate to the invention and these principles are not strictly limited to the specific condition recited in these examples. As a result it should be understood that the invention encompasses various changes and modifications to the examples described herein and such changes and modifications can be made without departing from the spirit and scope of the invention and without diminishing its intended advantages. It is therefore intended that such changes and modifications be covered by the appended claims.

Various samples of chemical additives were introduced to slurry of a papermaking process to evaluate their impact on dry strength. The samples were introduced into the papermaking machine producing cardboard while the machine was running at full speed. The pulp derived slurry passed through a thick stock line and then passed into an OCC (old corrugated cardboard) introduction point. The resulting paper was made out of a combination of virgin pulp and recycled OCC. DAA/AcAm was used as a representative example of all the above described amine-containing polymers. All of the DAA/AcAm copolymer was introduced as the slurry was traveling through a thick stock line. In some cases GPAM was pre-mixed and co-fed with the DAA/AcAm and in some cases the GPAM was subsequently fed in the OCC introduction point. The resulting dry strength was measured using a Concora Crush test according to TAPPI T824 protocols (it measures the edgewise compression performance of fluted medium that determines the contribution of the medium to the compression strength of the completed container). The dry strength was also measured using a ring crush test which tests the strength of liner or fluting both in the machine direction and perpendicular to it according to ISO 12192 and TAPPI T 822 protocols. All of the produced paper had the same basis weight. Table 1 summarizes the results.

TABLE 1

Effects of GPAM-DAA/AcAM on Dry Strength

| Sample | DAA/AcAm (lbs/Ton) of Slurry | Co-Fed GPAM (lbs/Ton) | Separately Fed GPAM (lbs/Ton) | Dry Strength (Concora) | Dry Strength (Ring Crush) |
|---|---|---|---|---|---|
| 1 | 0 | 0 | 0 | 65 | 63.4 |
| 2 | 0.75 | 0 | 0 | 73 | 59.9 |
| 3 | 1.5 | 0 | 0 | 69 | 60.4 |
| 4 | 1.5 | 1 | 0 | 66 | 58.2 |
| 5 | 1.5 | 2 | 0 | 76 | 56 |
| 6 | 1.5 | 3 | 0 | 74 | 57.3 |
| 7 | 1.5 | 2 | 1 | 72 | 58.3 |
| 8 | 1.5 | 1 | 2 | 69 | 57.1 |

The data demonstrates that efficient co-mixing of the GPAM with the amine-containing polymer imparts significant improvements in dry strength of the resulting paper. In particular the Dry Strength Concora measurements show the improvements in Dry strength. The better performance of the pre-mixed GPAM-amine-containing polymer over the combination formed when the two are separately mixed implies that the strength improvement is a function of how well mixed the two are and how well the two are allowed to interact with each other to form an effective 3D complex/crosslinked arrangement.

Studies were also done to measure the effect of an amine containing polymer added during the dry end of a papermaking process. A base paper sheet was coated on both sides using a drawdown method using solutions containing various chemistries. The solutions included either a low charge (less than or equal to 5000 functional group equivalent weight ionic groups) DAA/AcAm polymer strength aid, a high charge (more than 5000 functional group equivalent weight ionic groups) DAA/AcAm polymer strength aid, or no strength aid. The DAA/AcAm polymer strength aid was representative of amine containing polymers. The paper contained various amounts of filler particles and had not been through a size press device. The paper was weighed before and after each coating to determine the specific chemical dosage that remained affixed to the sheet. After the second coat the paper was pressed using a wringer with a total line pressure of 5 psi and dried by passing it once through a drum dryer at about 95° C. the samples were left to equilibrate at 23° C. and for at least 12 hours before testing for strength.

TABLE 2

Effects of Starch-DAA/AcAM on Tensile Strength

| Sample | Filler Content | Strength Aid Type | Starch (lbs/Ton Paper) | Strength Aid Dosage (lbs/Ton Paper) | Tensile Strength Index (N · m/g) | Elongation (%) | TEA (J/m$^2$) |
|---|---|---|---|---|---|---|---|
| A | 16% | — | 0 | 0 | 35 | 1 | 27 |
| B | 16% | — | 47 | 0 | 38 | 2 | 33 |
| C | 16% | — | 72 | 0 | 49 | 2 | 60 |
| D | 22% | — | 0 | 0 | 39 | 1.86 | 32 |
| E | 22% | — | 52 | 0 | 47 | 2.17 | 45 |
| F | 22% | DAA/AcAm-1 | 57 | 1 | 48 | 2.36 | 51 |
| G | 22% | DAA/AcAm-1 | 47 | 6 | 52 | 2.44 | 56 |
| H | 22% | DAA/AcAm-2 | 54 | 1 | 49 | 2.30 | 50 |
| I | 22% | DAA/AcAm-2 | 45 | 6 | 53 | 2.45 | 57 |

The results demonstrated a number of items. Starch alone without a strength aid provides increasing amounts of tensile strength and tensile energy absorbance (TEA). For samples A-C, for a 16% filler grade the Tensile Strength Index increase for starch alone was 0.44 N·m/g/lbs/ton.

Examples D and E indicate that for a 22% filler grade starch alone imparts a Tensile Strength Index increase of 0.15 N·m/g/lbs/ton. The combination of starch with the amine containing polymer however ups the increase to ~1 N·m/g/lbs/ton suggesting that the amine containing polymer increases tensile strength by a factor of 6-7.

Another test was run which demonstrates the effectiveness of co-feeding the GPAM with an amine-containing polymer on a different kind of paper material, 100% OCC (old/recycled corrugated cardboard) paper. A DAA/AcAm polymer was used as a representative of all sorts of amine-containing polymers. Paper products were formed from batches in which only GPAM was added, only the amine-containing polymer was added or both were added at the same time and location but were not pre-mixed prior to their addition. Table 3 lists the results which demonstrate that compared to GPAM and amine-containing polymer alone increases strength, but when co-fed, they significant increase strength such as dry strength and STFI strength to a level in excess of the maximum possible GPAM strength. All dosages in Table 3 are in lbs. of actives basis polymer per ton of oven dried paper.

TABLE 3

Effects of GPAM and DAA/AcAm on OCC Strength

| Sample | DAA/AcAm (lbs/Ton) | GPAM (lbs/Ton) | Dry Strength (Concora) | STFI Strength |
|---|---|---|---|---|
| 1 | — | 2.58 | 55.8 | 11.6 |
| 2 | 2.35 | — | 55.1 | 11.5 |
| 3 | — | 2.75 | 55.4 | 11.5 |
| 4 | 1.5 | 2.00 | 58.3 | 11.9 |
| 5 | — | 2.75 | 54.6 | 11.5 |

While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments mentioned herein, described herein and/or incorporated herein. In addition the invention encompasses any possible combination that also specifically excludes any one or some of the various embodiments mentioned herein, described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages, ratios and proportions herein are by weight unless otherwise specified.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of strengthening paper, the method comprising contacting a paper sheet in a wet end of a papermaking process with a composition, the composition comprising a glyoxalated polyacrylamide (GPAM) polymer and an amine containing polymer, wherein the amine containing polymer consists of a diallylamine acrylamide (DAA/AcAm) polymer, wherein the GPAM polymer comprises a copolymer of diallyldimethyl ammonium chloride and acrylamide (poly(DADMAC/AcAm)) having about 1 mole % to about 50 mole % of DADMAC monomer content and a weight average molecular weight from about 200,000 to about 1,500,000 Daltons; and wherein the GPAM polymer and the amine containing polymer are separately added at the same time and location within the wet end but are not pre-mixed, wherein the amine containing polymer comprises from about 10 to about 60 mole % of diallylamine, and the amine containing polymer has a weight average molecular weight from about 200,000 to about 1,500,000 Daltons.

2. The method of claim 1, wherein at least some of the GPAM and the amine containing polymer contact each other after they have contacted the paper sheet.

3. The method of claim 1, wherein the GPAM and the amine containing polymer crosslink to produce a higher molecular weight molecule.

4. The method of claim 1, wherein the amine containing polymer is added at an active basis dosage of 0.1 to 5000 gm/ton of oven dried paper sheet.

5. The method of claim 1, wherein the GPAM polymer is added at an active basis dosage of 0.1 to 5000 gm/ton of oven dried paper sheet.

6. The method of claim 1, wherein at least 10% of an oven dried mass of the paper sheet is filler particles and the paper has as a dry strength greater than a similar paper sheet lacking the amine containing polymer with at least a 2% lower amount of filler particles.

7. The method of claim 1, wherein at least 10% of an oven dried mass of the paper sheet is filler particles and the paper has as a dry strength greater than a similar paper sheet lacking the amine containing polymer with at least a 2% greater amount of filler particles.

8. The method of claim 1, wherein the GPAM polymer comprises $MgSO_4.7H_2O$.

9. The method of claim 1, wherein the GPAM polymer is added to the wet end of the papermaking process in an amount of about 2 to about 3 pounds per ton of oven dried paper.

10. The method of claim 1, wherein the amine containing polymer is added to the wet end of the papermaking process in an amount of about 0.75 to about 1.5 pounds per ton of oven dried paper.

11. The method of claim 1, wherein the GPAM polymer is added to the wet end of the papermaking process in an amount of about 2 to about 3 pounds per ton of oven dried paper, and the amine containing polymer is added to the wet end of the papermaking process in an amount of about 0.75 to about 1.5 pounds per ton of oven dried paper.

12. The method of claim 1, wherein the copolymer of diallyldimethyl ammonium chloride and acrylamide (poly (DADMAC/AcAm)) has about 12 mole % of DADMAC monomer content.

13. The method of claim 12, wherein the GPAM polymer is added to the wet end of the papermaking process in an amount of about 2 to about 3 pounds per ton of oven dried paper, and the amine containing polymer is added to the wet end of the papermaking process in an amount of about 0.75 to about 1.5 pounds per ton of oven dried paper.

14. The method of claim 1, wherein the copolymer of diallyldimethyl ammonium chloride and acrylamide (poly (DADMAC/AcAm)) has about 5 mole % of DADMAC monomer content.

15. The method of claim 14, wherein the GPAM polymer is added to the wet end of the papermaking process in an amount of about 2 to about 3 pounds per ton of oven dried paper, and the amine containing polymer is added to the wet end of the papermaking process in an amount of about 0.75 to about 1.5 pounds per ton of oven dried paper.

16. A method of strengthening paper, the method comprising:

contacting a paper sheet in a wet end of a papermaking process with a composition, the composition comprising a glyoxalated polyacrylamide (GPAM) polymer and an amine containing polymer, wherein the amine containing polymer consists of a diallylamine acrylamide (DAA/AcAm) polymer, and wherein the GPAM polymer and the amine containing polymer are premixed before being co-fed into the wet end, wherein the GPAM polymer comprises a copolymer of diallyldimethyl ammonium chloride and acrylamide (poly(DADMAC/AcAm)) having about 1 mole % to about 50 mole % of DADMAC monomer content;

wherein the amine containing polymer comprises from about 10 to about 60 mole % of diallylamine; and wherein the GPAM polymer is added to the wet end of the papermaking process in an amount of about 2 to about 3 pounds per ton of oven dried paper, and the amine containing polymer is added to the wet end of the papermaking process in an amount of about 0.75 to about 1.5 pounds per ton of oven dried paper.

* * * * *